United States Patent [19]

Skopek

[11] Patent Number: 4,823,696

[45] Date of Patent: Apr. 25, 1989

[54] HAND STAMP WITH SELF-INKING DEVICE

[76] Inventor: Karl Skopek, Dr. Franz Arming Strasse 5, A-4600 Wels, Austria

[21] Appl. No.: 124,853

[22] PCT Filed: Feb. 13, 1987

[86] PCT No.: PCT/AT87/00006

§ 371 Date: Oct. 23, 1987

§ 102(e) Date: Oct. 23, 1987

[87] PCT Pub. No.: WO87/04980

PCT Pub. Date: Aug. 27, 1987

[30] Foreign Application Priority Data

Feb. 13, 1987 [AT] Austria ..... 476/86

[51] Int. Cl.[4] ..... B41K 1/40

[52] U.S. Cl. ..... 101/334

[58] Field of Search ..... 101/327, 333, 334

[56] References Cited

U.S. PATENT DOCUMENTS

| | | | |
|---|---|---|---|
| 201,048 | 3/1878 | Roberts et al. | 101/334 |
| 454,499 | 6/1891 | Ryer | 101/334 |
| 1,083,336 | 1/1914 | Parker | 101/334 |
| 2,252,649 | 8/1941 | Smallman | 101/333 |
| 2,939,390 | 6/1960 | Clausing | 101/334 |
| 3,216,352 | 11/1965 | Schnackel | 101/333 |
| 3,760,721 | 9/1973 | Stier, Sr. | 101/334 |

FOREIGN PATENT DOCUMENTS

| | | | |
|---|---|---|---|
| 90240 | 4/1922 | Austria | 101/334 |
| 2020162 | 11/1971 | Fed. Rep. of Germany | 101/334 |
| 7321559 | 6/1973 | France | 101/334 |
| 11081 | 1/1982 | Japan | 101/334 |

*Primary Examiner*—David A. Wiecking

*Attorney, Agent, or Firm*—Kurt Kelman

[57] ABSTRACT

Hand stamp with a self-inking device and provided with an inversion mechanism arranged in a housing (3), said mechanism moving the printing types (4, 5) of the stamp from an upwardly pointing position adjacent to the ink carrier (6) inserted in the housing, downwardly into the printing position, during which movement such mechanism pivots, such mechanism, for actuating such inversion and printing action, being connected with a U-shaped actuating yoke (12) extending across the housing. The housing (3) of the stamp has a frame part (1) made of metal, in which the inversion mechanism and the printing types are arranged, and a plastic guide element (2) arranged on the top side of the frame part, such guide element being placed on the frame part or inserted in the latter. The guide element (2) forms a guide for sliding in the ink carrier and preferably aslo guides for the actuating yoke (12).

6 Claims, 2 Drawing Sheets

HAND STAMP WITH SELF-INKING DEVICE

The invention relates to a hand stamp with a self-inking device provided with an inversion mechanism located in a housing, said mechanism moving the printing types of the stamp from an upwardly pointing position adjacent to the ink carrier inserted in the housing, downwardly into the printing position, during which motion such mechanism is pivoting, and, for actuating such inverting and printing action, such mechanism being linked with a U-shaped actuating yoke extending across the housing, the legs of such yoke being displaceably supported on the lateral surfaces of the housing, and which yoke, by means of a spring having its one end supported on a transverse support provided in the housing, is movable upwardly into the position in which the printing types come to rest against the ink carrier, and depressible by hand into the position conforming to the printing position of the printing types.

Hand stamps of the above type are known, such stamps having housings made of metal. It is a drawback that the manufacture of such housings requires great expenditure in that the housing has to perform a great number of different functions, that is, for example, in addition to supporting the inversion mechanism for the printing types, the housing has to displaceably support also the actuating yoke and hold the ink carrier in a way such that the latter is readily accessible or removable. The reason for such great expenditure is that provision has to be made on the housing for a number of parts and that the housing has to be worked in a greater number of locations so as to be capable of performing the aforementioned functions with sufficient accuracy.

One objective of the present invention is to create a hand stamp of the type specified above having a housing that can be manufactured in a significantly simpler manner than the metal housings of the type of hand stamps commonly in use heretofore, while at the same time having good stability and being readily capable of withstanding both frequent use and high stresses acting on the stamp.

The hand stamp according to the invention, such stamp being of the type described above, is characterized in that the housing of the stamp has a frame part made of metal and a plastic guide element arranged on the top side of the frame part. The inversion mechanism and the printing types are arranged in the frame part and the guide element is attached to the frame part or inserted in the latter. Two longitudinal edge strips are arranged on both sides of the frame part and extend parallel to the swivel axis of the printing types, such strips being connected with one another by a bridge extending across or through the frame part and forming a guide with at least one opening in one longitudinal edge strip for sliding in the ink carrier, such guide being formed by such strips alone or by the latter jointly with the top wall of the frame part. The above-mentioned objective can be very well accomplished by the embodiment according to the invention. The housing has very good stability by virtue of the metal frame part, in which the inversion mechanism and the printing types are arranged. The frame part can be manufactured in a relatively simple way as it is not required to perform various supporting and guiding functions required for the stamp. Such guiding and supporting functions, which required accuracy but not the capability of absorbing strong forces, are performed by the guide element. Such functions include, for example, the accommodation and guidance of the ink carrier. Making the guide element from plastic material permits an exact manufacture of such element with relatively little manufacturing expenditure. Furthermore, by providing the stamp with the guide element, it is possible to create in a relatively simple manner the condition for using an ink carrier designed to be pushed in in the manner of a drawer. For the person handling the stamp, such an ink carrier can be inserted in a manner simpler and with less risk of soiling than ink carriers embodied in the form of a pan, which, with the known hand stamps of the type here under discussion, usually have to be inserted in a recess of the housing substantially perpendicular to their inking surface. Furthermore, sliding an ink carrier into the housing in the manner of a drawer permits providing the housing with covers within the zone of the strips extending along the longitudinal edges of the guide element, which excludes the risk of soiling for the most part when the stamp is in use.

A preferred embodiment of the hand stamp according to the invention, which permits accomplishing a practically safe cohesion between the guide element and the frame part when these two parts of the housing are assembled by simply placing or attaching the guide element to the frame part in the manner of a cap, is characterized in that the guide element is placed on the frame part and has cross edge strips which outwardly rest against the side walls of the frame part. A preferred additional feature of said embodiment, which permits in a constructionally simple manner an exact guidance of the actuating yoke with the help of the guide element, is characterized in that each of the cross edge strips has a groove for matchingly receiving one leg of the actuating yoke, or that such strips are interrupted or broken so as to form such a groove jointly with the side wall of the frame part disposed underneath.

Furthermore, an advantageous embodiment is characterized in that the bridge of the guide element supports in its center an upwardly projecting sleeve, the latter being integrated with the guide element, forming one piece with the latter. The spring pushing the actuating yoke upwardly, such spring being a spiral spring, is inserted in said sleeve with its lower part. The sleeve engages a socket from the bottom, the latter being provided on the actuating yoke and connecting the latter with a handle. This embodiment assures good guidance of the spring of the stamp pushing or forcing the actuating yoke upwardly and, furthermore, enhances the guidance of the actuating yoke on the guide element of the stamp housing.

For the purpose of exactly positioning the guide element on the frame part of the housing of the stamp, it is advantageous to make provision that on its bottom side, the bridge has an attachment engaging a recess provided on the top side of the frame part.

Due to the presence of the guide element in the hand stamp embodied according to the invention, it is possible to create in a simple manner a sight window behind which a stamp printing sheet can be accomodated. This will significantly facilitate the use of the stamp especially if different types of stamp have to be used frequently. Such an embodiment is characterized in that a transparent cover is arranged on one longitudinal edge strip of the guide element, such cover forming a compartment for suitably inserting a stamp printing sheet.

The invention is explained in greater detail in the following by reference to an example schematically shown in the drawing, in which.

Figure 2:
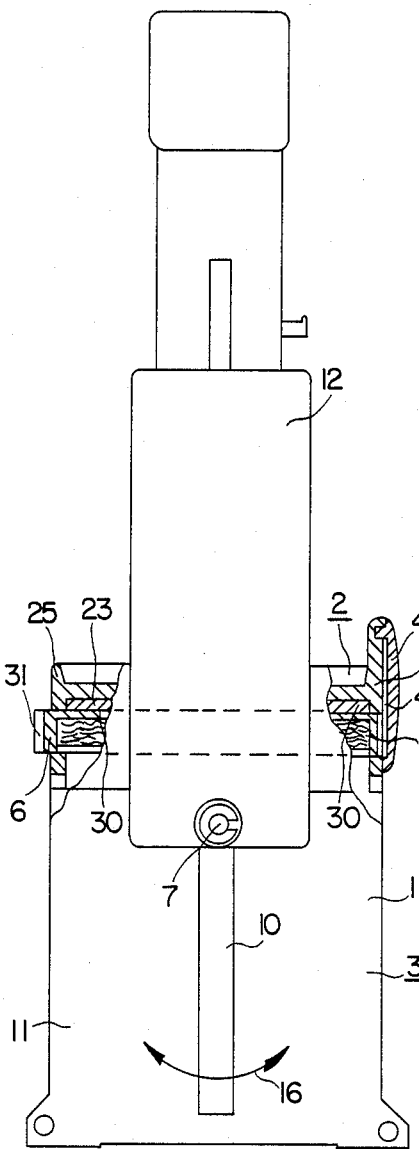
FIG. 2 shows a side view of the stamp of FIG. 1, also partly cut open.
Figure 1:
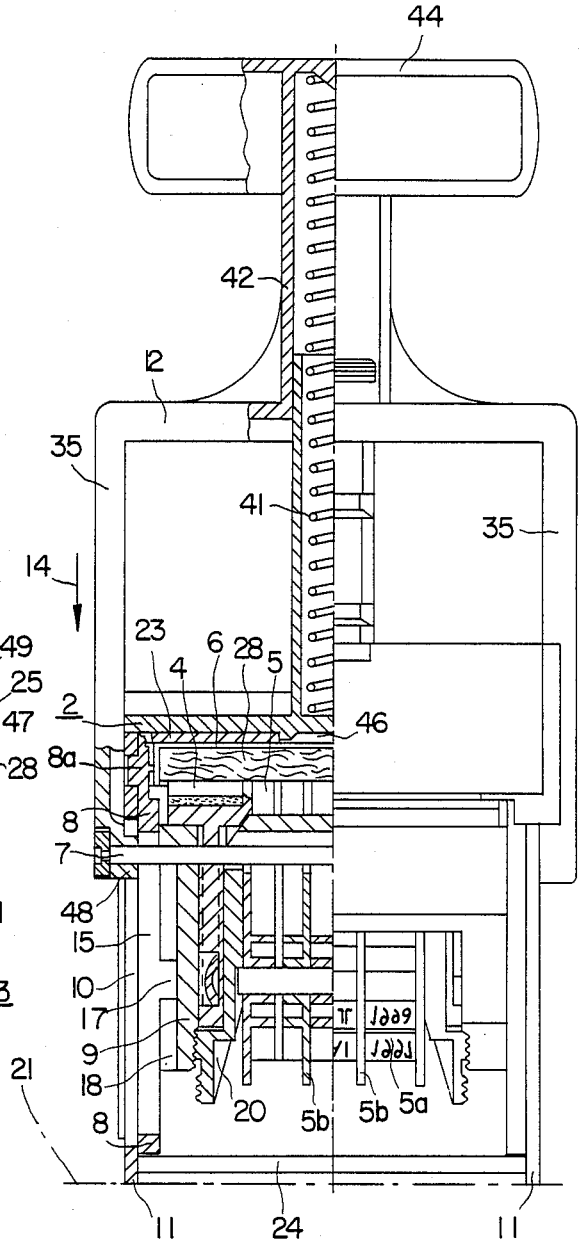
FIG. 1 shows a front view of a stamp embodied according to the invention, said view being partly cut open.

The hand stamp shown in the drawing has a housing 3 consisting of a frame part 1 and a guide element 2. An inversion mechanism is arranged in the housing, which mechanism moves the printing types 4, 5 of the stamp from an upwardly pointing position, in which the printing types 4, 5 rest against a drawer-like ink carrier 6 with an ink pad 28 (said position being shown in FIG. 1), downwardly into the printing position. In the example shown, the inversion mechanism is formed in the common manner by a deflection and swivel axle 7, the swivel arms 8 and the swivel arms 9. For moving the printing types into their printing position, the deflection and swivel axle 7, which is displaceably supported in the slots 10 provided in the two sides walls 11 of the frame part, is moved downwardly in the sense of arrow 14 by means of the actuating yoke 12, whereby said axle passes downwardly through the slots 15 disposed in the swivel arms 8. As said slots 15 have a curved shape, the swivel arms 8 swing back and forth around their journals 8*a* in the sense of arrow 16 as the deflection and swivel axle 7 is moving downward. The swivel arms 8 support the journals 17, which engage the longitudinal slots 18 of the swivel arms 9. Such engagement causes the swivel arms 9 to be deflected together with the deflection of the swivel arms 8 as the deflection and swivel axis 7 is moving downward, the latter being supported in a through-bore in the printing type unit 20, and such deflection of the swivel arms 9, in cooperation with the downward movement of the deflection and swivel axle 7, causes the printing type unit 20 to turn by 180 degrees and the printing types to be pressed against the setup surface 21 of the stamp.

In the embodiment shown, the printing type unit 20 supports the adjustable printing types 5, which, for example, are designed to print a date, and which are seated on the type belts 5*a*, which can be adjusted with the set wheels 5*b*; and furthermore a printing plate 4, the latter producing an imprint surrounding the imprint of the adjustable types 5.

Figure 3:
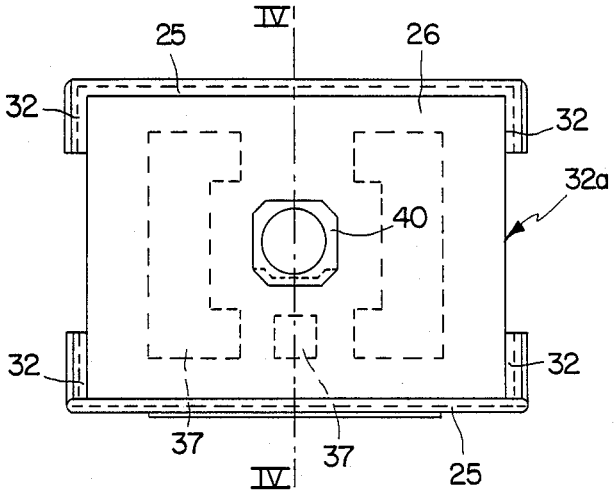
FIG. 3 shows a top view of the guide element for said stamp.
Figure 4:
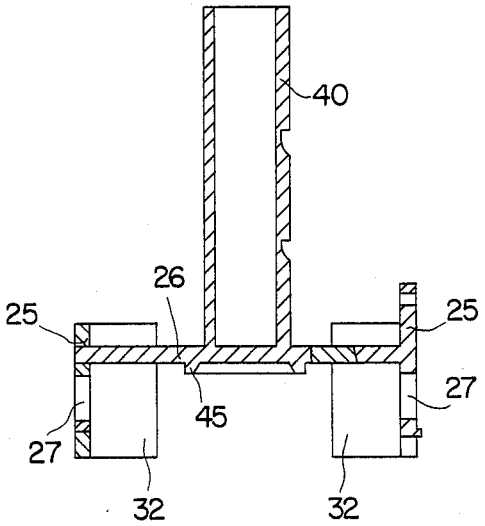
FIG. 4 shows a sectional view of said guide element with a cut along line IV—IV in FIG. 3.

The frame part 1 of the stamp housing 3 consists of metal and is comprised of the side walls 11 forming a U-shaped yoke with top wall 23, and the connecting rods 24, connecting the bottom ends of the opposed side walls 11 with one another. The plastic guide element 2 is attached to the top side of the frame part 1. As best shown in FIGS. 3 and 4, guide element 2 has two longitudinal edge strips 25 arranged on both sides of the frame part and extending parallel with the swivel axle 7 of the printing types 4, 5. Strips 25 are connected with one another by a bridge 26 extending across the frame part 1 and have the openings 27. The two longitudinal edge strips and downwardly pointing surface 30 of top wall 23 jointly form a guide for the drawer-like ink carrier 6 holding ink pad 28. The opening 27 arranged in the one longitudinal edge strip 25 forms an opening for sliding in the ink carrier 6. A handle attachment 31 is provided on the ink carrier 6 for the purpose of facilitating the handling of the latter.

The guide element is made from plastic material and the elasticity of such material permits in a simple manner an exact fit of the ink carrier in the guide and at the same time an easy exchange of the ink carrier.

Instead of placing the guide element 2 on the frame part 1 in the manner shown in the example, the guide element may be inserted in the frame part in a way such that the bridge 26 of the guide element 2 comes to rest on the downwardly pointing surface 30 of the top wall 23 of the frame part 1.

In the embodiment shown, the guide element 2 has the cross edge strips 32 which outwardly rest on the side wall 11 of the frame part 1. Said cross edge strips secure the guide element 2 against lateral displacement with respect to frame part 1 and at the same time form a guide for the actuating yoke 12, which extends across the housing 3 sideways. For this purpose, the cross edge strips 32 are broken in their centers, forming grooves 32*a* jointly with underlying side wall 11 of the frame part 1 groove matchingly receiving a leg 35 of the actuating yoke 12. Instead of interrupting the cross edge strip 32, it would be possible also to provide said strips with a groove for receiving a leg of the actuating yoke.

The bridge 26 of the guide element 2 may be a solid plate as shown in the drawing, or it may be subdivided into a number of strips by the breakthroughs 37, which are shown in the drawing by dashed lines.

In the embodiment shown, the bridge 26 of the guide element 2 supports in the center an upwardly projecting sleeve 40, which is integrated with the guide element, forming one piece with the latter. The lower part of spring 41, which is a spiral spring forcing the actuating yoke 12 upwardly, is inserted in said sleeve. The sleeve 40 engages a socket 42 from the bottom, the latter being provided on the actuating yoke 12 and connecting the latter with a handle 44. This engagement, too, forms a guide between the guide element 2 and the actuating yoke 12. In addition, the actuating yoke 12 is guided by the attachments 48 engaging the slots 10.

On its bottom side, the bridge 26 supports an attachment 45 engaging a recess 46 in the top side of the frame part. In this way, an exact positioning of the guide element 2 on the frame part 1 is accomplished.

A transparent cover 49 is arranged on the one longitudinal edge strip 25 of the guide element 2 for forming jointly with said strip a compartment 47 suitable for inserting therein a stamp printing sheet.

I claim:

1. A hand stamp comprising, in combination, (a) a housing comprising a metal frame part which includes (1) a top wall and (2) two side walls extending downwardly from the top wall and forming a U-shaped yoke jointly with the top wall, (b) printing types and an inversion mechanism arranged in the housing for moving the printing types about a pivot between an upwardly pointing inking position and a downwardly pointing printing position, (c) an ink carrier slidably inserted in the housing like a drawer adjacent the upwardly pointing inking position of the printing types, (d) an integral guide element body of plastic material carried by the metal frame part adjacent the top wall thereof, the plastic guide element body including (1) two longitudinal edge strips each spinning between the two side walls of the metal frame part and extending parallel to the pivot of the printing types, at least one of the edge strips defining an opening through which the ink carrier is slidably inserted (2) a bridge interconnecting the two longitudinal edge strips across the metal frame part whereby the ink carrier may be pushed through said opening between the two longitudinal edge strips and may be guided therealong like a drawer, and (3) a sleeve projecting upwardly from the bridge centrally intermediate the side walls, (e) a U-shaped actuating yoke extending across the housing for moving the printing types between said positions, the actuating yoke including (1) respective legs slidably supported on the side walls, (f) a spiral spring having a lower end guided in the upwardly projecting sleeve of the guide element body and upwardly biasing the actuating yoke into a position wherein the printing types are in contact with the ink carrier, and (g) a downwardly projecting socket with a handle connected thereto, the upwardly projecting sleeve being slidably guided in the downwardly projecting socket and the socket receiving an upper end of the spiral spring whereby manual depression of the handle against the spring bias will move the printing types into the printing position.

2. The hand stamp of claim 1, wherein the bridge extends above the top wall, and the top wall of the metal frame part jointly with the opening in the guide element body form a guide wherealong the ink carrier may be slid like a drawer.

3. The hand stamp of claim 2, wherein the plastic guide element body further includes two cross edge strips resting on the outside of the side walls of the metal frame part, the side walls underlying the cross edge strips.

4. The hand stamp of claim 3, wherein the cross edge strips are interrupted to form respective grooves with the underlying side walls, the actuating yoke having downwardly projecting legs guidingly received in the grooves.

5. The hand stamp of claim 1, wherein the bridge of the plastic guide element body has a downwardly projecting attachment engaging a matching recess in the top wall of the metal frame part.

6. The hand stamp of claim 1, further comprising a transparent cover arranged over one of said longitudinal edge strips and forming a compartment with said one longitudinal edge strip for inserting a stamp printing sheet therein.

* * * * *

UNITED STATES PATENT AND TRADEMARK OFFICE

CERTIFICATE OF CORRECTION

PATENT NO. : 4,823,696

DATED : April 25, 1989

INVENTOR(S) : KARL SKOPEK

It is certified that error appears in the above-identified patent and that said Letters Patent is hereby corrected as shown below:

Cover page, item [30]: delete "Feb. 13, 1987" and substitute therefor --Feb. 24, 1986--.

Signed and Sealed this

Twelfth Day of June, 1990

*Attest:*

HARRY F. MANBECK, JR.

*Attesting Officer*

*Commissioner of Patents and Trademarks*